United States Patent [19]

Nagy

[11] Patent Number: 4,889,376

[45] Date of Patent: Dec. 26, 1989

[54] BOX HOLDER WITH HANDLE

[76] Inventor: Thomas Nagy, 128A McCaul Street, Toronto, Ontario, Canada, M5T 1W1

[21] Appl. No.: 286,705

[22] Filed: Dec. 20, 1988

[51] Int. Cl.[4] ..... B65D 23/10

[52] U.S. Cl. ..... 294/33; 220/85 H

[58] Field of Search ..... 294/33, 27.1, 31.2, 294/32, 137, 142, 148, 166; 220/85 H, 94 R; 16/114 R; 215/100 A; 222/465, 475; 248/145.6; D7/70, 71; D9/443, 455

[56] References Cited

U.S. PATENT DOCUMENTS

| | | | |
|---|---|---|---|
| 159,292 | 7/1950 | Olson | 220/85 H |
| 2,782,064 | 2/1957 | Montgomery | 294/31.2 |
| 2,902,309 | 9/1959 | House | 294/33 |
| 2,976,074 | 3/1961 | Weinar et al. | 294/31.2 |
| 2,992,847 | 7/1961 | Lemke | 294/31.2 |
| 3,012,809 | 12/1961 | Tremaine | 294/31.2 |
| 3,017,215 | 1/1962 | Galipeau | 294/31.2 |
| 3,056,622 | 10/1962 | Hilderbrandt | 294/31.2 |
| 3,073,642 | 1/1963 | Barnes | 294/31.2 |
| 3,086,806 | 4/1963 | McAndrew | 294/33 |
| 3,250,562 | 5/1966 | Frasure et al. | 294/31.2 |
| 3,262,618 | 7/1966 | Miller | 220/85 H |
| 3,421,789 | 1/1969 | Klomparens | 294/31.2 |
| 3,615,115 | 10/1971 | Simms | 294/31.2 |
| 3,674,300 | 7/1972 | Simms | 294/31.2 |
| 4,120,073 | 10/1978 | Studebaker | 16/114 R |

FOREIGN PATENT DOCUMENTS

| | | |
|---|---|---|
| 724020 | 12/1965 | Canada . |
| 927336 | 5/1973 | Canada . |
| 1123400 | 5/1982 | Canada . |

*Primary Examiner*—Johnny D. Cherry

[57] ABSTRACT

The present invention provides a holder for a rectangular carton of the milk-type variety having a triangulated top with a forward pour spout and a rearward recess in the top opposing the pour spout. The holder itself comprises an upper and a lower set of rectangular arms, an upper tongue and a rearward handle. The arms in at least the upper set are resiliently spreadable for spreading outwardly to fit the tongue in the rearward recess in the top of the carbon and for thereafter rebounding inwardly to clamp to the front of the carton with the tongue fitted into position. The arms in the lower set may be additionally spreadable to assist in the fitting of the holder to the carton.

3 Claims, 3 Drawing Sheets

BOX HOLDER WITH HANDLE

FIELD OF THE INVENTION

The present invention relates to a holder with a handle for fitting to a carton of the type used for milk, juice, etcetera.

BACKGROUND OF THE INVENTION

As most people will appreciate, cartons of the type used for milk, juice, etcetera are often awkward and heavy to handle. This is particularly true when the carton is taken out of the fridge when there is generally condensation on the side of the carton adding further to the difficulty in holding and pouring the contents of the carton.

The above problems occur on cartons of the smaller size, for example a one quart carton, and are even worse on larger cartons as for example cartons of the two quart size.

Carton holders have been developed in the past to overcome these problems. These prior carton holders do work, however they are so awkward to work with that they have not met with any commercial success. In particular, prior art carton holders comprise a band-like construction which totally wraps around the carton making the holder extremely awkward to fit into position. One of the prior art carton holders includes a belt-like construction having an adjustable buckle which requires the opening and resecuring of the belt for placing the holder on one carton and them removing it to put it on a new carton.

SUMMARY OF THE PRESENT INVENTION

The present invention provides a holder for a rectangular carton of the type having a triangulated top with a forward pour spout and a rearward recess in the top opposing the pour spout as typically used for example in a milk or juice carton. The holder of the present invention which is easily made to fit all different sizes of cartons is designed to not only hold the carton but also to be quickly and easily fitted into position unlike the prior art holders as earlier described.

In particular, the holder of the present invention comprises an upper and a lower set of arms having right angular forward arm regions with the sets of arms being vertically spaced from one another. The holder further includes an upper tongue and a rearward handle.

The arms in at least the upper set of arms are resiliently spreadable for spreading outwardly to fit the tongue penetrating into the rearward recess in the top of the carton and to then rebound inwardly so that the right angular forward arm regions clamp to the front of the carton with the tongue fitted into position. The arms in the lower set of arms may additionally be resiliently spreadable to assist in the fitting of the holder to the carton.

As a result of the resiliently spreadable nature of the upper set of arms in particular, the holder is quickly and easily fitted into position and just as easily removed from the carton when it is empty for use with a further like carton.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
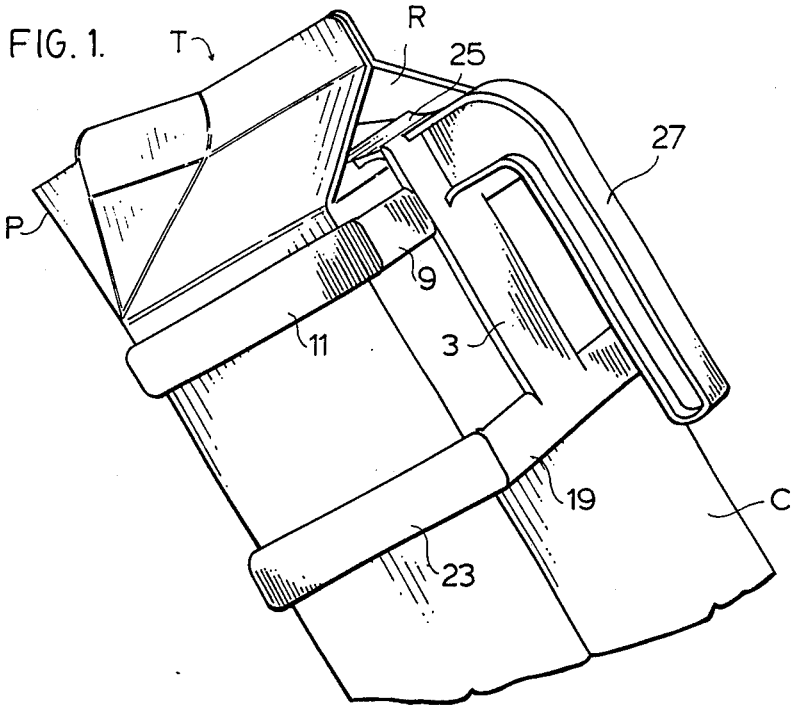
FIG. 1 is a perspective view of the upper part of a carton fitted with a holder according to a preferred embodiment of the present invention.

FIG. 1 shows a carton C for milk, juice and other liquid products to be dispensed from the carton. This carton includes a triangulated top T having a forward pouring spout P and a rearward recess R opposing the pouring spout.

Figure 2:
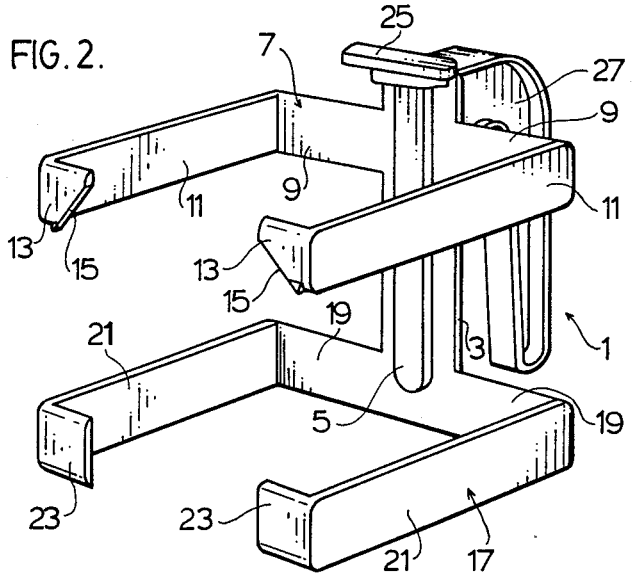
FIG. 2 is a perspective view of the carton holder of FIG. 1.

The present invention comprises a carton holder as best seen in FIG. 2 and generally indicated at 1. The carton holder fits to the carton as well seen in FIG. 1 of the drawings.

Carton holder 1 comprises a main spine 3 which is centrally reinforced by a reinforcing rib 5. Supported by the spine is an upper set of arms generally indicated at 7 and a lower set of arms generally indicated at 17. As will be seen in FIG. 2 of the drawings, the upper and lower sets of arms are vertically spaced from one another.

Also supported by spine 3 is an upper tongue-like projection 25. Provided to the rear of the spine is a handle 27.

The key to the present invention lies in the construction of the upper and lower sets of arms, both of which have right angular forward arm regions as seen in the drawings. Both sets of arms have an open rectangular construction meaning that each of the sets of arms are opened to the front of the holder. The upper set of arms comprises a pair of rearward arm sections 9, one to either side of the spine, a pair of forwardly extending arm sections 11 and a pair of short inwardly turned forward arm sections 13.

The lower set of arms comprises a pair of rear arm sections 19, again one to either side of the spine, a pair of forwardly extending arm sections 21 and a pair of short inwardly turned forward arm sections 23.

The ease of fitting the holder to the carton is achieved as a result of at least the upper arms being spreadable. As will be seen in FIGS. 3 and 4 of the drawings, the holder is mounted to the carton by initially dropping the lower set of arms down from above onto the carton. These arms are sized such that they provide a snug fit wrapping partially around the carton. As will be seen in FIG. 4, there is an open region between arm portions 23 at the front of the carton with sufficient wrap around by these arm portions to firmly grip the carton. Generally it is not required to spread the lower set of arms for sliding down along the carton. However, if it is required, these arms are easily spreadable by bending them outwardly from the supporting spine and, because of the nature of the material from which the holder is constructed, the arms will then spring back inwardly to their partial wrap around position.

Figure 3:
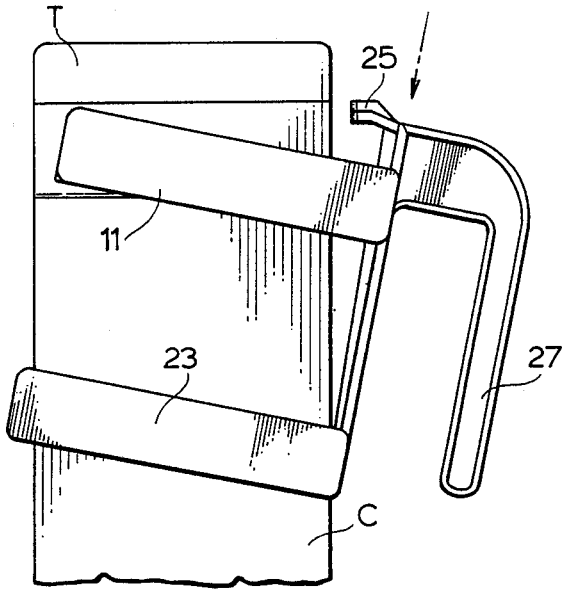
FIG. 3 is a side view showing the fitting of the holder to the carton of FIG. 1.
Figure 4:
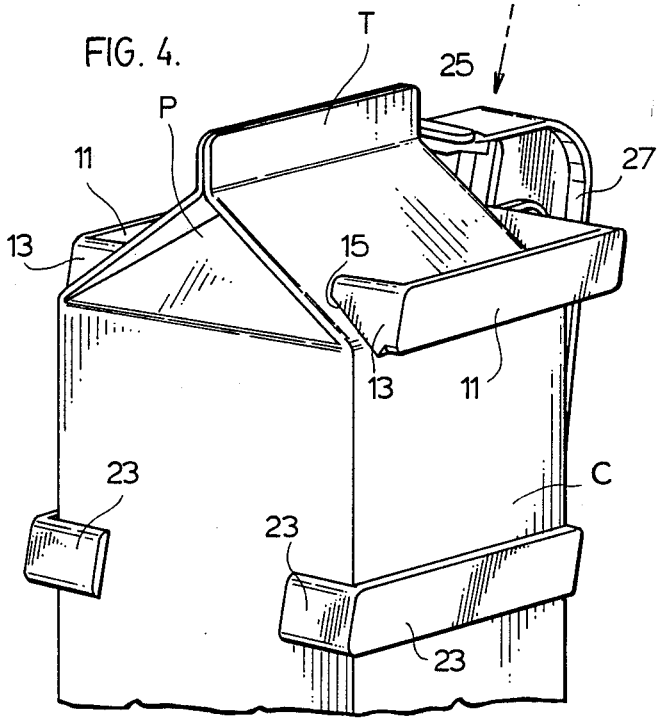
FIG. 4 is the front view of the fitting of FIG. 3.

In fitting the upper set of arms to the carton, the spreadability of the arms becomes important. In particular, in order to get tongue 25 into the recess R at the back of the top of the carton, the upper set of arms must be pulled rearwardly where arm sections 13 are spread to the outer sides of the carton as seen in FIG. 3 and 4 of the drawings. This then provides appropriate clearance to position tongue 25 in alignment with the recess at which point the top end of the holder is simply slid forwardly causing arms sections 13 to slide both downwardly along and to the front of the carton where they then pop into the carton holding position seen in FIG. 6 of the drawings. Here it should be noted that arm portions 13 are provided with a bevelled lower surface 15 which enhances their ability to slide across the carton as seen in FIGS. 3 and 4 of the drawings.

As mentioned above, the construction of the holder allows the spreadability of the arms which then rebound inwardly to a carton gripping position. In the preferred embodiment of the present invention, the holder is made from a plastic material which allows spreading without breaking of the arms and which further has resilient properties to cause the arms to return to their set position according to the memory of the plastic. The plastic construction also adds to the light weight and ease of handling of the holder.

Figure 5:
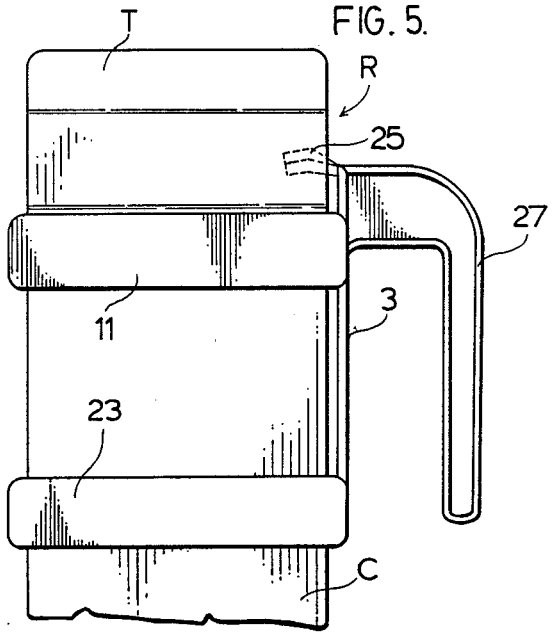
FIG. 5 is a side view of the holder fitted into position on the carton of FIG. 1.
Figure 6:
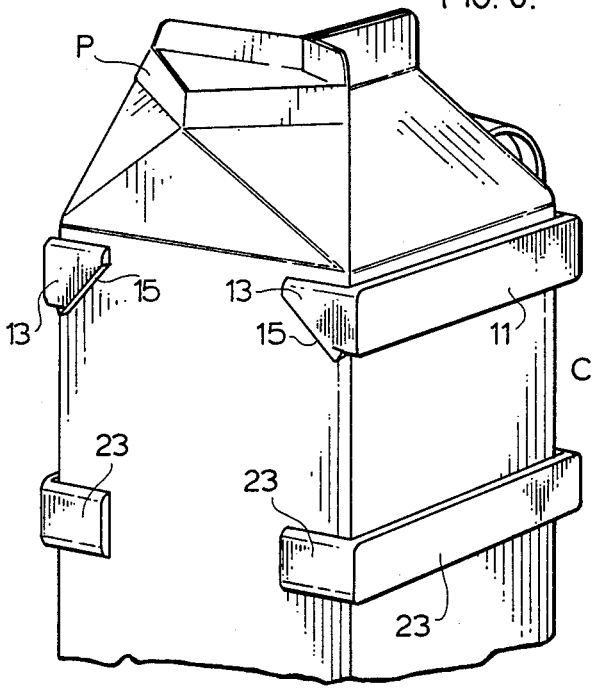
FIG. 6 is a front view of the fitting of FIG. 5.

When the holder is fitted as shown in FIG. 5 to the carton, the support provided by arm portions 13 and 23, even with their limited overlap to the front of the carton, is more than sufficient to support it when tipped to a pouring position as shown in FIG. 6. The provision of tongue 25 fitted into recess R stabilizes the fitting and prevents the holder from sliding along the length of the carton.

A number of features result from the open front construction of both arm sets. For example, the entire holder can be removed by sliding it up off of the carton without having to close the pour spout because the arms slide to either side of the spout. Furthermore, any spillage from the spout goes down through the open front of the holder rather than onto the holder substantially enhancing its hygiene.

As described above, it is important that at least the upper set of arms be spreadable and some of this spreading occurs at the juncture between the upper set of arms and the spine 3. However, at the same time, it is important that the spine be sufficiently stiff to support the entire structure including the rearward handle 27. This stiffness is provided by the stiffening rib 5 running up the center of the spine and into the tongue 25 which is also strengthened by the stiffening rib.

Handle 27 for manipulating the holder once it is in position on the carton is itself built with lightweight strengthening features. In particular, the handle has an I-beam type construction for maximum strength with a minimum amount of material required in the handle.

It will now be seen from the description above how the lightweight carton holder of the present invention is extremely easy to mount to and remove from a carton, while at the same time very efficiently gripping the carton. No special adjustments and the like are required to mount the holder to the carton which once in position provides an extremely effective assist for handling the carton regardless of its size.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A holder for a rectangular carton of the type having a triangulated top with a forward pour spout and a rearward recess in the top opposing the pour spout, said holder comprising an upper and a lower set of arms, a supporting spine for said upper and lower set of arms, a tongue projecting forwardly from said spine above said upper set of arms and a rearward handle on said spine, said upper and lower sets of arms comprising opposing arm members spreadable from one another and said upper and lower sets of arms being separated from and spreadable independently of one another, each of the arms in said sets of arms comprising a rear arm section, a forwardly extending arm section at right angles to said rear arm section, and a short forward arm section at right angles to said forwardly extending arm section, the short forward arm sections in each of the arms in both of said sets being separated from one another and the short forward arm sections in said upper set of arms having a downwardly outwardly bevelled straight edge providing cam means for riding along the carton and spreading said upper set of arms to place said tongue in the rearward recess in the top of the carton with said lower arm set already wrapped tightly around the carton.

2. A holder as claimed in claim 1, having a plastic construction, said plastic construction making said upper set of arms resiliently spreadable.

3. A holder as claimed in claim 1, including a supporting vertical spine for said sets of arms, tongue and said handle, said arms in said upper and lower sets being flexible at said spine, and said spine being centrally reinforced upwardly to said tongue.

* * * * *